US005276299A

United States Patent [19]

Marsh

[11] Patent Number: 5,276,299

[45] Date of Patent: Jan. 4, 1994

[54] ELEVATOR LIMIT SWITCH

[75] Inventor: Beryl F. M. Marsh, Unionville, Conn.

[73] Assignee: Otis Elevator Company, Farmington, Conn.

[21] Appl. No.: 787,856

[22] Filed: Nov. 5, 1991

[51] Int. Cl.[5] ..... H01H 19/20

[52] U.S. Cl. ..... 200/570; 200/47; 200/280

[58] Field of Search ..... 200/47, 176, 570, 558, 200/559, 568, 569, 243, 250, 280, 281, 6; 187/31, 34, 35, 36, 50, 121

[56] References Cited

U.S. PATENT DOCUMENTS

| | | | |
|---|---|---|---|
| 1,359,435 | 11/1920 | Schafer | 200/562 |
| 1,944,471 | 1/1934 | Seeger | 187/31 |
| 1,945,734 | 2/1934 | Cullimer | 187/31 |
| 2,366,474 | 1/1945 | Bentley | 200/557 |
| 2,808,901 | 10/1957 | Chadwick | 187/31 |
| 2,809,260 | 10/1957 | Beckett | 200/562 |
| 3,309,544 | 3/1967 | Lowson | 200/559 |
| 3,590,177 | 6/1971 | Ustin | 200/47 |
| 3,657,503 | 4/1972 | Smith | 200/570 |
| 3,748,419 | 7/1973 | Torrey et al. | 200/570 |
| 4,511,769 | 4/1985 | Sahakian et al. | 200/562 |
| 4,831,221 | 5/1989 | Yu et al. | 200/553 |

*Primary Examiner*—Henry J. Recla
*Assistant Examiner*—David J. Walczak

[57] ABSTRACT

An elevator limit switch is constructed of molded plastic box and lid and is readily adaptable for left side or right side use on an elevator or an elevator hoistway. The box and lid hold a one piece plastic hub which carries a mounting system for holding readily reversible electrical contacts.

9 Claims, 2 Drawing Sheets

ELEVATOR LIMIT SWITCH

TECHNICAL FIELD

This invention relates to an elevator limit switch for use in a hoistway.

BACKGROUND ART

Elevator equipment is located in either hoistway or the machine room. In addition to a car, counterweight, and ropes, the hoistway contains many components that are essential to the safety and performance of the elevator. These include car and counterweight guide rails, pit equipment, a car position reader, hoistway doors, and top and bottom terminal landing limit switches.

Limit switches are mounted on brackets attached to car guide rails at the top and bottom terminal landings in the hoistway. The limit switches are actuated ("opened") by a cam that rides with the car to ensure that the car does not collide with the overhead hoistway structure or compress the elevator buffer.

In a typical mid-rise installation, four limit switches are located at each terminal landing. The first two are slowdown limit switches that are opened before the car reaches the landing. A third limit switch is located at the landing and opens to provide a signal to prevent further travel of the car beyond the landing. A fourth and final limit switch is opened when the car passes the terminal landing and provides a signal to prevent all further travel in either direction.

In some high-rise, high-speed installations, the switches may be mounted on the car. The switches are opened sequentially by cams located at the top and bottom terminal landings.

Existing elevator limit switches have an abundance of parts, are noisy due to the backlash inherent in the assembled parts, are difficult to assemble, inclined to rust, and relatively vulnerable to dust or water.

DISCLOSURE OF THE INVENTION

It is an object of the invention to provide an easily constructed elevator limit switch.

It is a further object of the invention to provide a limit switch which is resistent to rust, dust and water.

It is a further object of the invention to provide a limit switch which is relatively quiet.

It is a further object of the invention to provide a limit switch which may be readily attached to either side of the hoistway or the elevator car.

According to the invention, an elevator limit switch is constructed of molded plastic box and lid and is readily adaptable for left side or right side use on an elevator or an elevator hoistway. The box and lid hold a one piece plastic hub which carries a mounting system for holding readily reversible electrical contacts.

According to a feature of the invention, the lid is constructed of a translucent plastic.

Because the lid and the box of the limit switch are plastic, it is rust resistent. Because the box, lid and hub have a sealed construction, the switch is resistent to dust and water infiltration. Because the parts are of a molded, self-lubricating plastic, noise is diminished as the switch operates. Because of a minimized number of parts, the switch is easily and quickly constructed. Because the lid is translucent, an operator may visually inspect the interior of the box for maintenance purposes.

These and other objects, features, and advantages of the present invention will become more apparent in light of the following detailed description of a best mode embodiment thereof, as illustrated in the accompanied drawings.

BEST MODE FOR CARRYING OUT THE INVENTION

Figure 1:
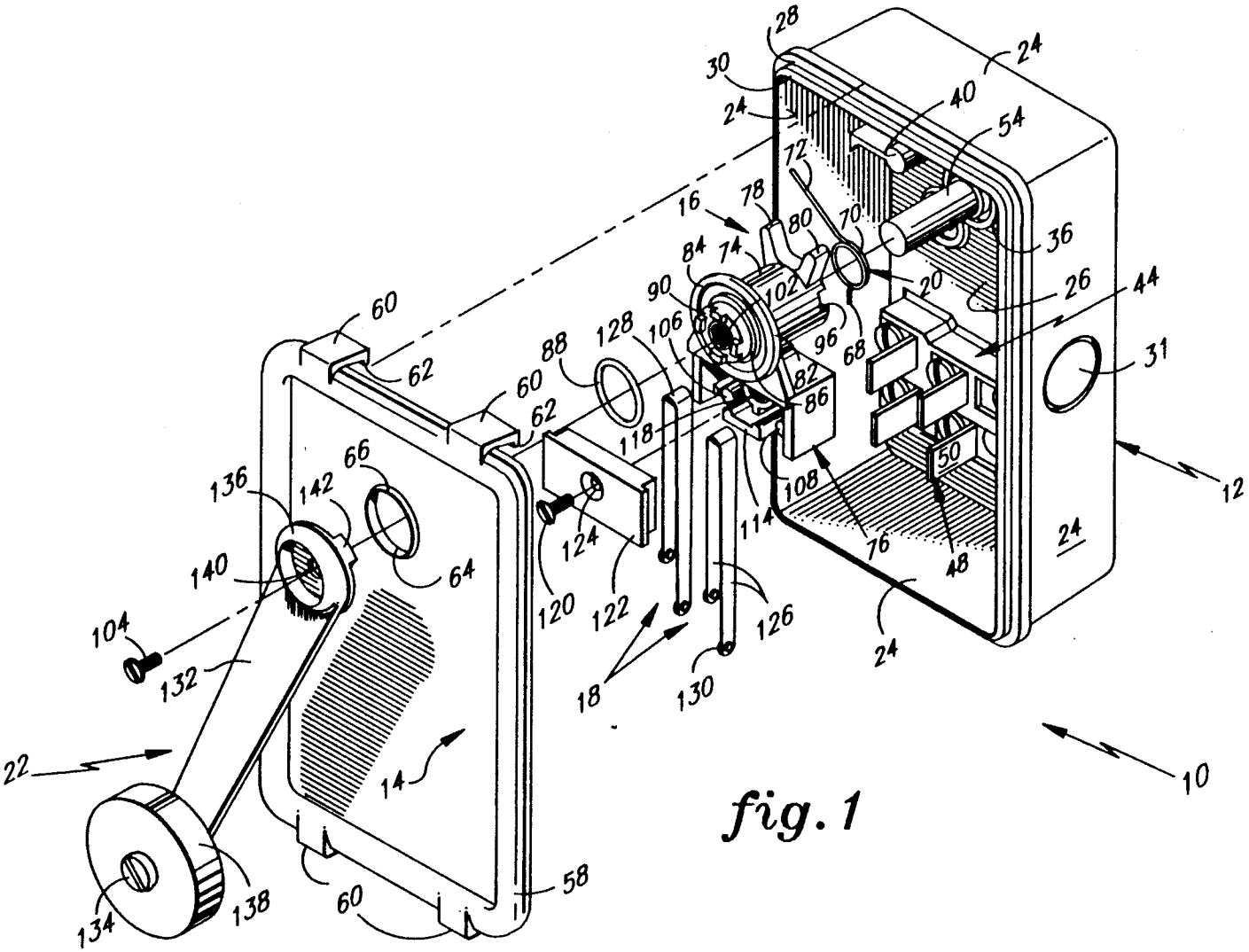
FIG. 1 is a perspective view, partially broken away of the limit switch of the invention.
Figure 3:
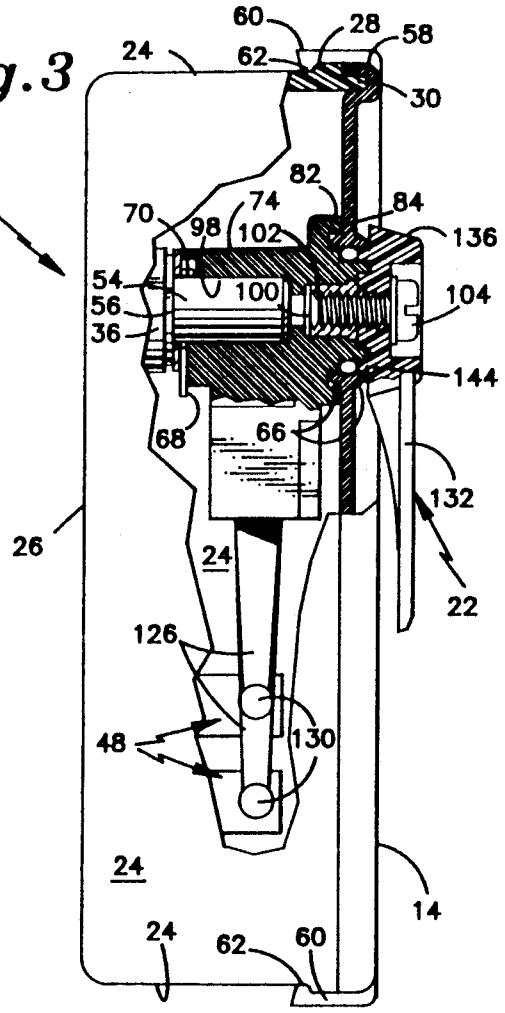
FIG. 3 is a side view, partially broken away, of the switch of FIG. 1.
Figure 2:
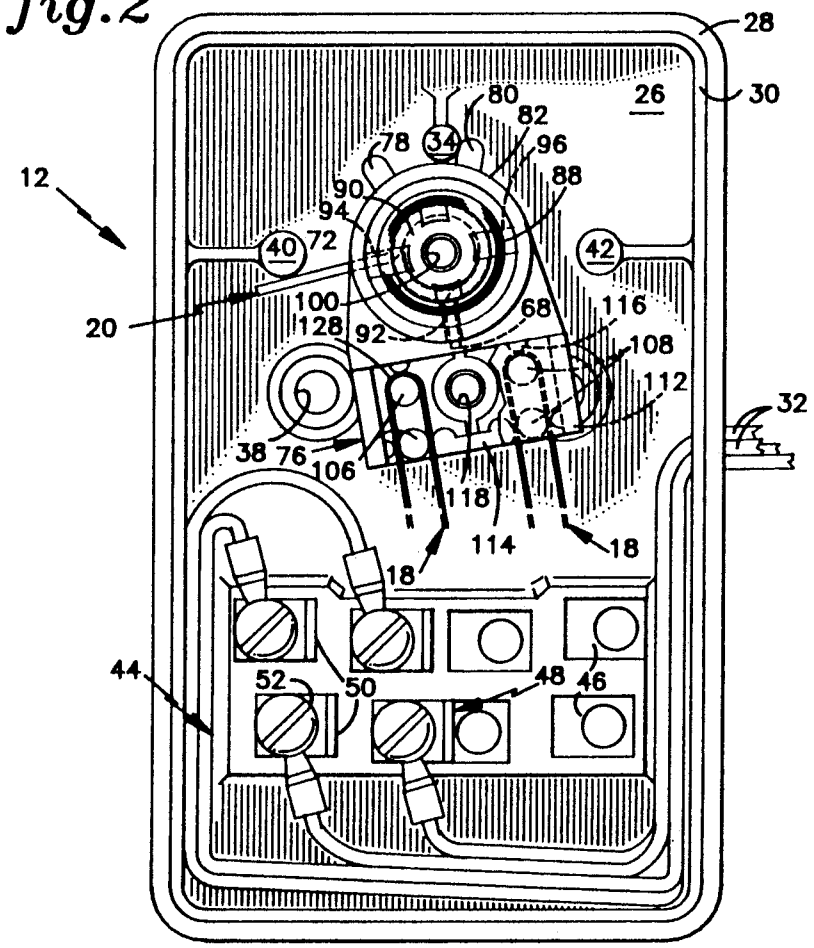
FIG. 2 is a front view, partially broken away, of the switch of FIG. 1.

Referring to FIGS. 1-3, a best mode embodiment of the limit switch 10 of the invention is shown. The limit switch comprises a box 12, a lid 14, a hub 16, at least one reversible contact 18, a spring 20, and an arm 22. The arm and hub are constructed of a high strength, high lubricity, flame retardant plastic, such as DELRIN manufactured by the E. I. Dupont De Nemours and Company. The box is similarly constructed of a high strength, high lubricity, flame retardant plastic, such as NORYL N190 manufactured by the General Electric Company of Lynn, Mass. The lid be made of a translucent Lexan also made by General Electric or of any translucent plastic with proper flame retardant and strength properties. The plastic material of the arm and hub helps to minimize wear and noise as the switch operates. The translucent plastic lid allows a maintenance worker to view the interior of the switch to determine whether repairs are required.

The box is conventionally shaped having four integrally connected sidewalls 24, each of which is integrally connected to a back wall 26. Each sidewall 24 has a bead 28 extending therealong and a lip 30 (see FIGS. 2 and 3) for cooperating with the lid 14, as will be discussed infra. One sidewall has a cylindrical indent 31 therein which allows a portion of the sidewall to be knocked out to receive electrical conduits 32 as is known in the art (see FIG. 2).

Referring to FIGS. 2 and 3, the back wall 26 has molded therein; a limit post 34, a cylindrically shaped spindle mount 36, a pair of mounting holes 38, a left spring seat 40, a right spring seat 42, and a spade mounting assembly 44. The spade mounting assembly is a roughly rectangular raised portion which has a plurality of openings 46 to mount a plurality of L-shaped spade terminals 48 therein. Each terminal 48 has a raised blade 50 and a base portion 52 which fits in the openings in the raised portion. A threaded sleeve (not shown) is welded ultrasonically within each opening 46 to permit the spade terminals and the conduits 32 to be screwed into the assembly.

A metallic axle 54 is ultrasonically welded within the spindle mount 36. The axle has a flange 56 extending therearound for determining the depth of placement of the axle within the spindle mount.

The lid 14 is rectangularly shaped for fitting upon the sidewalls 24 of the box. A chime 58 is disposed along the edges of the lid. The lip 30 of the box is designed to cooperate with the chime to form a labyrinth seal. The labyrinth seal minimizes dust and water infiltration into the interior of the box and minimizes the amount of noise emanating therefrom. A plurality of snap-fit legs 60 extend from the chime, each leg having a tab 62 for gripping the bead 28 on the box 12. The tabs ensure that the lid fits securely to the box.

The lid 14 has a central opening 64 for receiving the hub 16 as will be discussed infra. The opening has raised ridges 66 extending therearound on the front and back of the lid for cooperating with the hub to form another labyrinth seal as will be discussed infra.

The spring 20 has a first arm 68, a coil portion 70 disposed about the axle 54, and a second arm 72 for engaging the left and right spring seats 40, 42 as will be discussed infra.

The hub 16 comprises a barrel-shaped body 74 and a rectangularly-shaped contact assembly integrally formed therewith. The exterior of the body has: a first arm 78 and a second arm 80 which extend radially therefrom and act as rotation limiters; a flange 82 which extends radially outwardly therefrom, the flange having a lip 84 (see FIG. 3) for engaging the lid 14; an area of reduced diameter 86 forming a seat for an O-ring 88 which cooperates with the opening 64 in the lid to seal the interior of the box 12; a pair of slots 90 for fixedly engaging the arm; a seat opening 92 for allowing the first arm 68 of the spring 20 to extend therethrough; and a left opening 94 and a right opening 96 for allowing the second arm 72 of the spring to engage either the left and right spring seats 40, 42, as may be required.

The interior of the hub has a first bore 98 for receiving the spindle 54, and a second bore 100 for receiving a threaded insert 102 so that the arm 22 can be attached thereto by means of a screw 104, as will be discussed infra.

The roughly rectangular contact assembly 76 extends downwardly from the hub. The assembly as shown has: a left pair of vertically aligned posts 106 and a right pair of vertically aligned posts 108, each pair receiving a contact 18, as will be discussed infra; a left side wall 110; a right side wall 112; a front wall 114 disposed between the left and right posts 106, 108; a pair of nipples 116 for holding the contacts within the contact assembly and a threaded sleeve 118 for receiving a screw 120. A cover 122 has an opening 124 through which the screw 120 extends to engages the threaded sleeve 118 thereby enclosing the contacts within the assembly.

Each contact has a pair of flexible legs 126 joined by a U-shaped portion 128. The length of each leg depends on its distance from a spade terminal 48. The end of each leg has a contact 130 riveted thereto. The contacts are typically constructed of copper.

The arm 22 has an extended portion 132, a spindle 134, a hub 136, and a cam follower or roller 138. The hub 136 has a central opening 140 through which screw 104 extends to attach to the threaded portion 102 of the hub 16. The hub 136 has a blade 142 for insertion in either slot 90 depending on whether the roller 138 is to extend beyond the left or right side of the switch 10. The hub has a portion 144 of reduced diameter (see FIG. 3) for insertion in the opening 34 in the lid. The spindle 134 is fixedly attached to the arm and may be split into four sections (not shown) to allow the roller to be press fitted thereupon.

The lip in the lid 64, the area of reduced diameter in the hub 144, the O-ring 88 and the lip 84 of the hub 16 cooperate to create a labyrinth seal to minimize the infiltration of the box by dust and water and to minimize the amount of noise emanating from the box.

To construct the switch: the threaded sleeves (not shown) and axle 54 are ultrasonically mounted to the box; a portion 31 of the box is knocked out and electrical conduits 32 are inserted and attached, with the spade terminals 48 into the spade mounting assembly 44; the spring 20 is disposed about the axle; the first opening 68 of the hub 16 is positioned about the axle with the left hub limit 78 disposed on one side of the limit stop 34 and the right hub limit 80 disposed on the other side of the limit stop; an arm 68 of the spring is mounted in the slot 92; the second arm 72 of the spring extends out the left or right opening 94, 96 depending on which side of a hoistway (not shown) the switch is intended and engages the respective left or right spring seat 40, 42; the contacts 18 are positioned about the required pair of posts and are secured from movement between the nipple 116 and the front wall 114; the cover 122 is screwed into place over the contacts; the lid 14 is snap fitted over the box 12, the legs 60 being snapped over the bead 28 and the lip 30 engaging the chime 58; the arm 22 is disposed in the proper slot depending on which side of the hoistway the switch is intended; the arm is secured in place by screw 104; and, the roller 138 is snap fitted over the spindle 134.

Under normal operation, the spring 20 urges the arm of the hub against the limit stop 34 thereby extending the arm beyond the side of the box where it is in position to contact a cam surface (not shown) on either the hoistway or on the cab (not shown). When the cam surface engages the roller 138, the hub 16 is rotated so that the contacts 18 either move into or out of contact with the spade terminals 48 as may be required.

Although, the invention has been shown and described with respect to a best mode embodiment thereof, it should be understood by those of ordinary skill in the art, that various omission, changes and additions in the form and detail thereof may be made without departing from the spirit and scope of the invention.

I claim:

1. An elevator limit switch comprising:

a one-piece plastic box, a lid for enclosing said box, said lid cooperating with said box to minimize dust and water infiltration therein and minimize noise emanating from said box, an electrical contact, an electric circuit in said box a one-piece plastic hub, mounted for rotation within said box and extending through said lid, said hub having means for selectively fixedly attaching said electrical contact to said hub in a first position for completing or breaking said electrical circuit, as desired, in a first direction if said hub rotates in said first direction and fixedly attaching said electrical contact to said hub in a second position for completing or breaking said electrical circuit, as desired, in a second direction if said hub rotates in said second direction, and an arm attaching to said hub outside of said box for making contact with an elevator stimulus, whereby motion of said arm rotates said hub to break or complete said circuit as desired.

2. The elevator limit switch of claim 1 wherein said electrical contact comprises:

a one piece U-shaped construction.

3. The elevator limit switch of claim 1 wherein said hub further comprises:

means for selectively mounting a spring therein for urging said hub to rotate against said stimulus if said hub rotates in said first direction or if said hub rotates in said second direction.

4. The elevator limit switch of claim 1 wherein said hub further comprises:

means for cooperating with said lid for minimizing infiltration of dust and moisture within said box and the emanation of noise from said box.

5. The elevator limit switch of claim 4 wherein said cooperating means comprises:

a labyrinth seal.

6. The elevator limit switch of claim 1 further comprising:

said electrical contact comprising a one piece U-shaped construction having a pair of legs connected by a curved portion, and said means for selectively attaching comprises a post for engaging said U-shape of said contact so that said legs may complete or disengage an electrical circuit, as desired, in either said first or said second direction.

7. The elevator limit switch of claim 6 wherein said means for selectively attaching further comprises;

a second post for engaging said legs of said contact to secure said legs from movement relative to said hub.

8. The elevator limit switch of claim 1 wherein said lid and said box cooperate to form a labyrinth seal to minimize dust and water infiltration therein and minimize noise emanating from said box.

9. The elevator limit switch of claim 1 wherein said lid is comprised of a translucent material for allowing visual inspection of said box.

* * * * *